US005540490A

United States Patent [19]

Weidner

[11] Patent Number: 5,540,490

[45] **Date of Patent: * Jul. 30, 1996**

[54] DOCUMENT DISPLAY STAND

[76] Inventor: Merwyn C. Weidner, P.O. Box 98574, Des Moines, Wash. 98198

[ * ] Notice: The term of this patent shall not extend beyond the expiration date of Pat. No. 5,385,399.

[21] Appl. No.: 368,433

[22] Filed: Jan. 3, 1995

Related U.S. Application Data

[63] Continuation-in-part of Ser. No. 55,569, May 3, 1993, Pat. No. 5,385,399.

[51] Int. Cl.[6] ..... A47F 7/00

[52] U.S. Cl. ..... 312/190; 312/319.1; 312/323

[58] Field of Search ..... 312/190, 192, 312/322, 323, 319.1, 330.1, 334.1

[56] References Cited

U.S. PATENT DOCUMENTS

| | | | |
|---|---|---|---|
| 428,406 | 5/1890 | Noll et al. . | |
| 832,426 | 10/1906 | Sell . | |
| 1,205,604 | 11/1916 | Dungan . | |
| 1,274,446 | 8/1918 | Ratigan . | |
| 4,537,452 | 8/1985 | Rice et al. | 312/323 X |
| 5,065,920 | 11/1991 | Amner | 312/323 X |
| 5,385,399 | 1/1995 | Weidner | 312/323 X |

*Primary Examiner*—Hoang Nguyen
*Attorney, Agent, or Firm*—Graybeal Jackson Haley & Johnson

[57] ABSTRACT

A document display stand with a document supporting tray having a spring-loaded hold-down and line marking rod which spans substantially the full length of the tray and is positionable in any location across the width of the tray and which by interaction with its spring loading is also movable to a raised position spaced from the face of the tray so as to not impede repositioning or movement of a document onto or out of the tray. The stand includes pivotally movable and lockable legs for supporting the tray at various angles relative to a surface on which the stand is supported.

5 Claims, 3 Drawing Sheets

DOCUMENT DISPLAY STAND

CROSS-REFERENCE TO RELATED PATENT

This application is a continuation-in-part of my U.S. patent application Ser. No. 08/055,569, filed May 3, 1993, and entitled Document Storage and Display Cabinet which issued as U.S. Pat. No. 5,385,399 on Jan. 31, 1995.

BACKGROUND OF THE INVENTION

1. Field of the Invention

This invention relates to a document display stand with document hold-down means spanning and movable by the user across the entire face of the tray portion of the stand, with the stand also comprising foldable legs which are lockable in extended, tray supporting position.

2. Description of the Prior Art

Previously known are stand type copy or book holders such as disclosed in Putnam U.S. Pat. No. 1,161,339, wherein is disclosed a copy or book holder with a wire strand 11 which is movable vertically on the stand on rods 10, with the wire strand 11 serving to hold a book or paper on the stand in an open position. However, the configuration of the parts is such that the wire strand 11 of the Putnam stand is movable only vertically on the stand a distance less than the full vertical height of the face of the stand and does not span and is not movable horizontally relative to the face of the stand.

Storage cabinets with pull-out trays or drawers which display drawer contents with document hold-down means are also well-known, such as disclosed in Noll et al U.S. Pat. No. 428,406, Sell U.S. Pat. No. 832,426, Dungan U.S. Pat. No. 1,205,604, and Ratigan U.S. Pat. No. 1,274,446. However, in such cabinets and trays, the document hold-down means are typically movable in the sense of being liftable and are pressed by spring action against documents in a drawer but such hold-down means do not fully span and are not movable across the face of the drawer so as to function as a line marker in relation to and across the full width of a document filling and arranged open-face in the drawer, for example.

SUMMARY OF THE INVENTION

This invention provides in a document display stand, a document supporting tray equipped with a document hold-down rod which is designed to hold any given book or like document open on the face of the tray and to serve as a line marker at any desired level across the entire face of the tray. The stand of the invention is also designed to have foldable, extendable and lockable legs supporting the tray at several angular attitudes with respect to a horizontal or similar support surface.

It is also a feature and advantage of the the document display stand of the present invention that its hold-down means which spans substantially the entire horizontal width of the document supporting tray and is movable throughout the entire horizontal depth of the document supporting tray is spring-loaded so as to be urged by spring action against the face of the tray and also arranged in conjunction with its spring means to have a stable, at-rest position with the hold-down rod raised substantially above the face of the tray so that documents can be replaced or removed or changed in position relative to the face of the tray without the hold-down impeding such movement.

A further object and feature of the present invention is to provide in a display stand a document supporting tray and document hold-down and line marker means comprising guide rods arranged substantially parallel to the edges and spanning the width dimension of the face of the tray, with the document hold-down rod spanning substantially the entire width of the tray, and with two carriage means each movable along substantially the entire length of the associated guide rod, along with trunnion means on each of said carriage means to which a respective end of said hold-down and line marker rod is pivotally journaled with the span of said hold-down end line marker rod across the face of the tray being parallel to the inner and outer edges of the tray and laterally offset from the ends of the hold-down rod a distance at least about equal to the length of the said carriage means in the span thereof along the said guide rods, the arrangement also including slide means in the portions of the hold-down and line marker rod connecting the span portion of the hold-down rod with the ends thereof, and respective tension spring means extending between the ends of the carriage means and over said slide means, said spring means acting to urge said hold-down rod against the face of the tray yet permit the hold-down rod to be pivotally moved by the user from and to positions at either side of the carriage means, the rod in its middle position relative to the carriage means being stably maintained centrally well above the surface of the tray so as to be out of the way and not impede any desired movement, introduction or withdrawal by the user of a document or the like relative to the face of the tray.

These and other objects, features and advantages of the present invention will be apparent from the following description and accompanying drawings illustrating a preferred, typical embodiment thereof.

DESCRIPTION OF THE PREFERRED EMBODIMENT

Figure 1:
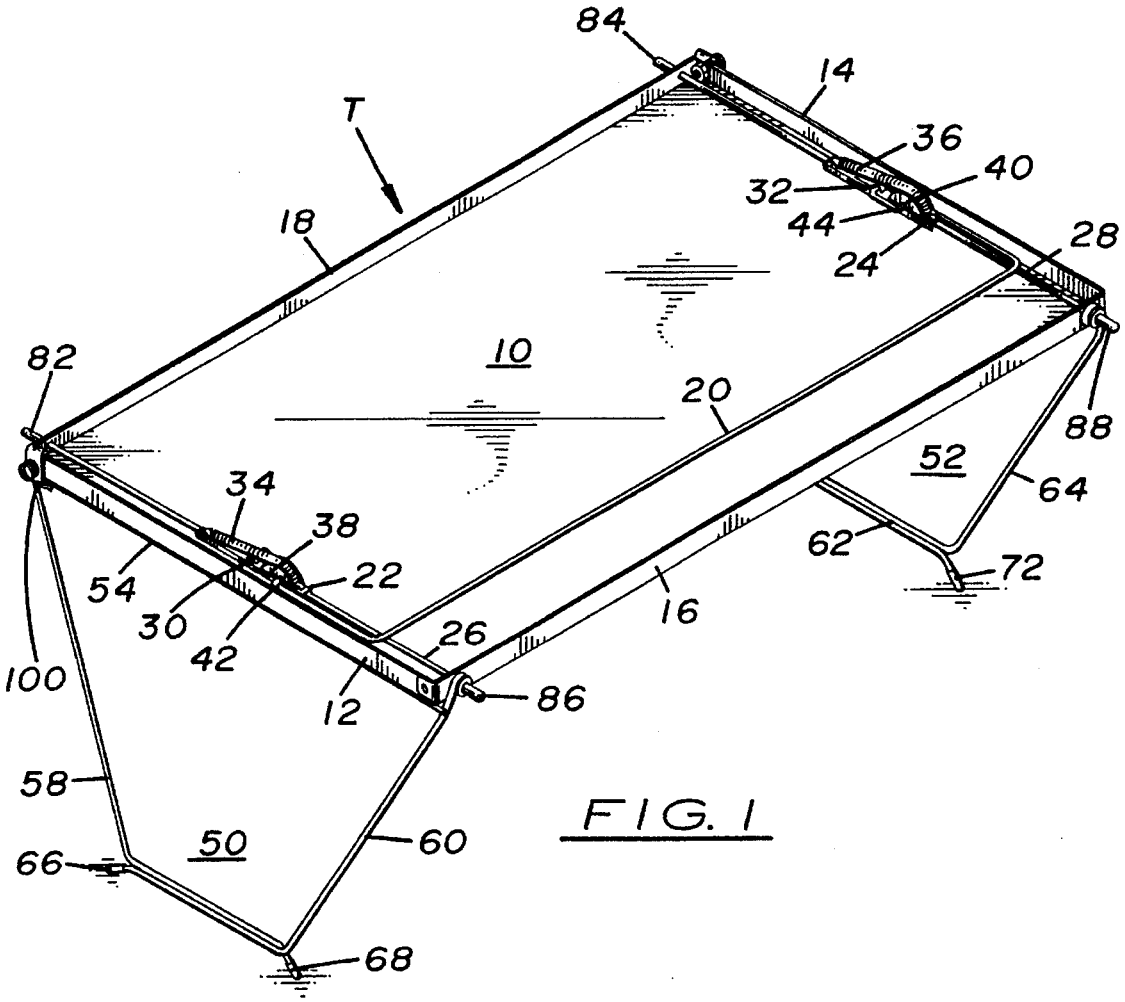
FIG. 1 is an isometric view of a document display tray according to the present invention, shown with its foldable legs extended and in tray supporting position.
Figure 2:
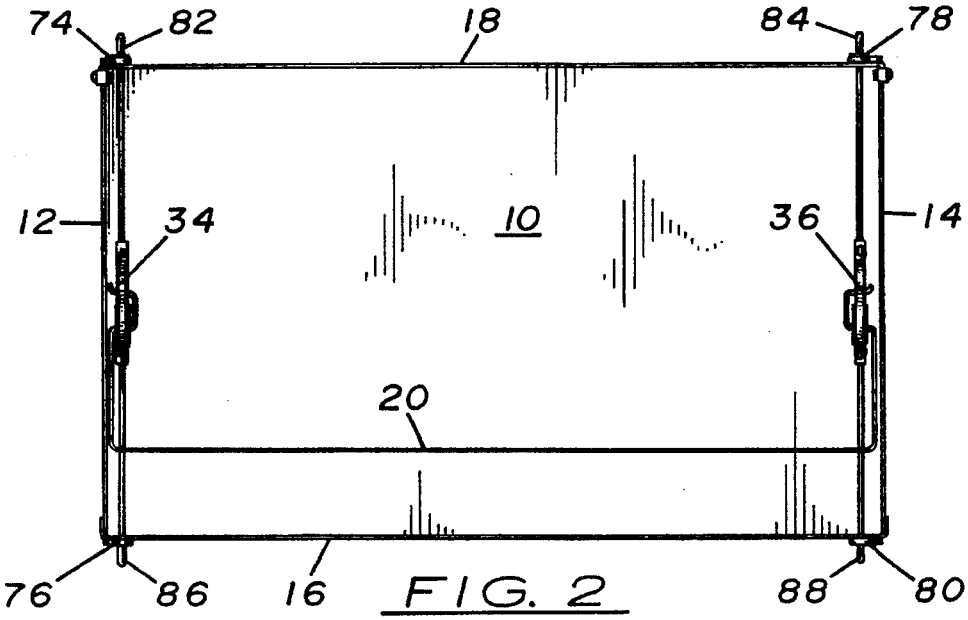
FIG. 2 is a top plan view of the document display stand shown in FIG. 1.
Figure 3:
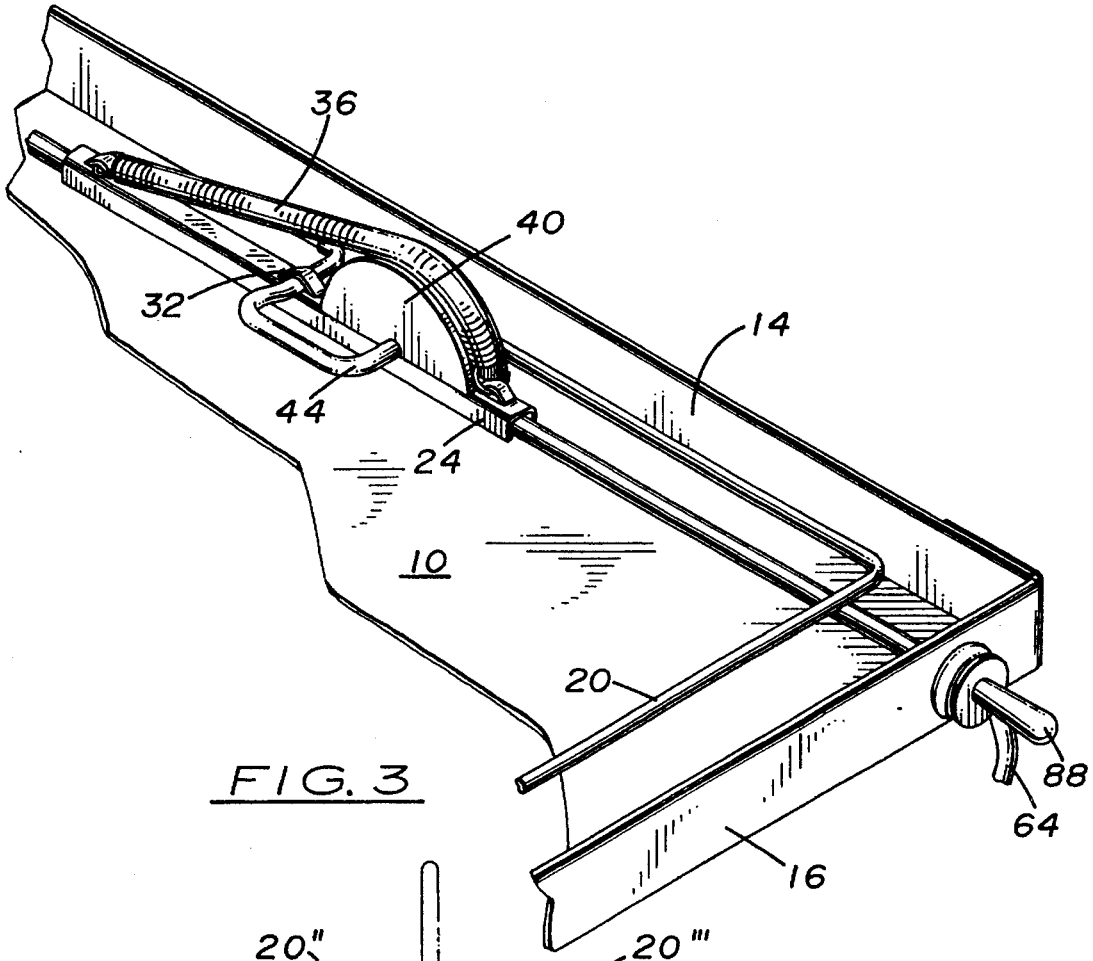
FIG. 3 is a fragmentary isometric view on an enlarged scale of a corner portion of the document tray of the stand shown in FIG. 1, further showing the hold-down rod, one of the carriage means and a portion of the associated guide rod on which the carriage means and hold-down rod move.
Figure 4:
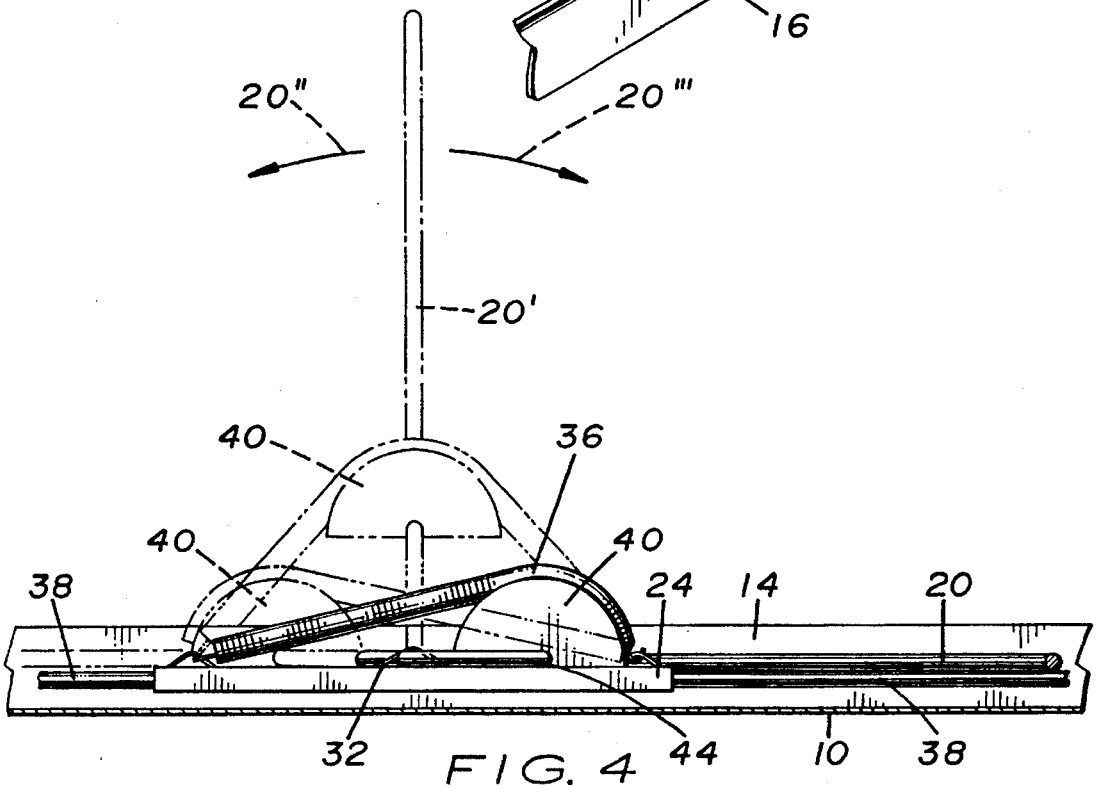
FIG. 4 is a fragmentary side view of the components shown in FIG. 3, further showing various positions of the hold-down rod and associated components thereof.

FIGS. 1 and 2 show respective isometric and top plan views of a document display stand which is the preferred embodiment of this invention. The stand comprises a tray T with an open face 10 and upwardly turned end edges 12, 14 and side edges 16, 18. Documents or the like, not shown, are placeable on the tray face 10 and are there held by fold-down and line marker rod 20. As shown in FIGS. 1 and 2, the hold-down line marker rod 20 spans substantially the entire horizontal width of the tray face 10 and is carried by mounting means enabling it to be moved to any desired position over substantially the entire horizontal depth of the tray T between the side edges 16, 18. The mounting means for the hold-down and line marker rod 20 includes carriages 22, 24 which are movable to any desired position between the side edges 16, 18 along respective guide rods 26, 28. Each of the carriages 22, 24 includes a trunnion means 30, 32 in which the respective ends of the rod 20 are pivotally journaled. Each such carriage means 22, 24 has attached thereto near its ends the ends of a tension spring 34, 36, each of which passes over a respective nylon, sector shaped, guide or slide 38, 40 which is mounted on and pivotally movable on a respective axially offset bend 42, 44 in the rod 20 near but offset from the end portion of the rod journaled at trunnion 26, 28. The springs 34, 36 load the rod 20 so that it normally presses against the face 10 of the tray T and any documents or the like on the face of the tray T. As perhaps best understood in connection with FIGS. 3 and 4, the arrangement of the springs 34, 36 and the slides 38, 40 on the bends 42, 44 of rod 20 is such that the rod 20, when in a relatively raised position with the rod extending substantially perpendicular of the face 10 of the tray T, is stably held in such position so that the rod 20 is out of the way and does not impede any movement of the documents on the tray face 10, as shown in broken line at FIG. 4 at 20', yet is easily brought into a position in pressing engagement with the face 10 of the tray T or any document or the like on the face 10 of the tray T simply by the user urging the rod 20 in the desired direction of pivotal movement, as schematically indicated in FIG. 4 at arrows 20" and 20'''.

The display stand of the present invention comprises the tray T with its associated hold-down components as above discussed and tray support legs 50, 52 which are pivotally movable with respect to the tray T from collapsed position nested against the underside of the tray T to an extended position as shown wherein the legs are extended substantially perpendicularly below the general plane of the underside of the plate P. Each of the legs 50, 52 comprises a joined rod construction of generally trapezoidal configuration with respective inboard tie rods 54, 56, and respective converging side rods 58, 60 interconnected by tie rod 54 and rods 62, 64 interconnected by tie rod 56, with the lower ends of the rods 58, 60, 62, 64 being bent and extending in an overlapping manner to terminate in respective support surface engaging feet 66, 68, 70, 72. The upper ends of the respective rods 58, 60, 62, 64 terminate in respective eyes 74, 76, 78, 80 which are retained on and pivotally movable with respect to the ends of the respective rods 26, 28 extending outwardly beyond the sides 18, 16 of the tray T.

Figure 5:
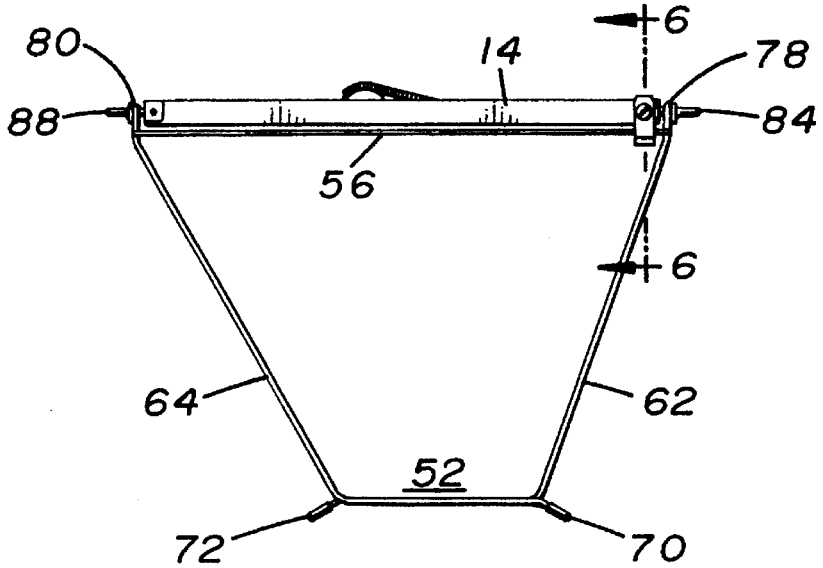
FIG. 5 is an end view of the stand shown in FIG. 1, and showing further detail with respect to the associated leg lock mechanism.

As evident to some extent in FIG. 1 and also in the end view of FIG. 5, with the legs 50, 52 erect and locked, the angular attitude of the leg side rods 58, 62 on the one hand and 60, 64 on the other hand are at different angles (60° and 70°, for example) relative to the face 10 of the tray T, which enables the tray T to be arranged with its surface either horizontal, with the feet 66, 68, 70, 72 engaging and supported by a horizontal surface, or at a relatively abrupt acute angle, with a horizontal supporting surface in engagement with feet 66, 70 and the ends 82, 84 of the rods 26, 28, or at a less abrupt acute angle relative to a horizontal supporting surface by engagement with the supporting surface of feet 68, 72 and the ends 86, 88 of the rods 26, 28.

Figure 6A:
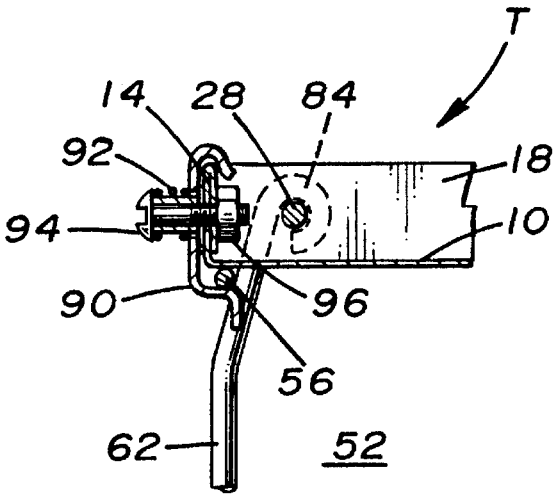
FIGS. 6A and 6B are enlarged detail views of the lock mechanism shown in FIG. 5, showing respective leg locking and leg unlocked positions thereof, both views being taken substantially along line 6—6 of FIG. 5.
Figure 6B:
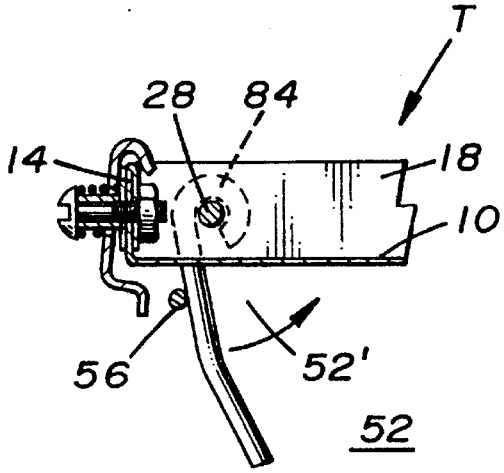

As indicated, the pivotally extendable legs 50, 52 are lockable in extended position to provide stable support for the tray T. In this respect, each of the legs 50, 52 is provided with a simple leg locking mechanism. In the instance of leg 50 this locking mechanism is adjacent the eye 78 of the leg rod 62 (in FIG. 6). Enlarged detail of this locking mechanism is shown in FIGS. 6A and 6B. A spring loaded latch assembly, including latch 90 and spring 92 retained by bolt 94 and nut 96 on the end edge 14 of the tray T, operates by reason of its bent configuration shown to engage the adjacent portion of tie rod 56 of the leg 52 which is in turn carried by the leg 62 thereof. With the latch 90 in such engagement with the tie rod 56, the leg rod 62 and thus the leg 52 are held in rigid extended position below the tray T. To release the leg 52 and fold it to a more or less nested position near or against the lower surface of the tray T, the latch 90 is pulled away from the tie rod 56 against the compression of spring 92 and the rod 56 released as shown in FIG. 6B, whereupon the leg 52 is pivotally movable as indicated by the arrow designated 52'.

A locking mechanism with a latch element like latch 90 is designated 100 in FIG. 1 and is operable in conjunction with leg tie rod 54 and leg rod 58 of leg 50 to lock the leg 50 in the extended position shown in FIG. 1 or to unlock it in like manner as does the mechanism shown in FIGS. 6A and 6B.

As will be evident, the stand is usable for display of many types of documents including books, maps, folders, spreadsheets and the like.

These and other advantages, features, modifications and adaptations of the present invention will be apparent to those skilled in the art to which the invention is addressed within the scope of the following claims.

What is claimed is:

1. In a display stand for documents, comprising a tray and a document hold-down means movable with respect to the face of the tray and urged against the face of the document to hold the document in place on the tray, the improvement wherein said tray is supported by pivotally movable and lockable legs and said hold-down means comprises a spring loaded rod spanning substantially the entire horizontal width of the tray, and mounting means for said rod enabling it to be moved to any desired position over substantially the entire horizontal depth of the tray.

2. In a display stand according to claim 1, wherein said document hold-down means comprises guide rods arranged substantially parallel to the edges and spanning the height dimension of the tray face, and wherein said spring loaded rod functions as a hold-down rod spanning substantially the entire width of the tray face, and two carriage means each movable along substantially the entire length of a respective one of said guide rods, trunnion means on each of said carriage means to which a respective end of said hold-down rod is pivotally journalled, with the span of said hold-down rod across the face of the tray being parallel to the inner and outer edges of the tray and laterally offset from the ends of the hold-down rod a distance at least about equal to the length of the said carriage means in the span thereof along said guide rods, slide means in the portions of the hold-down rod connecting the span portion of the hold-down rod with the ends thereof, and respective tension spring means extending between ends to the carriage means and over said slide means, said spring means acting to urge said hold-down rod against the face of the tray yet permit the hold-down rod to be pivotally moved by the user from and to positions at either side of the carriage means, the coordinated sliding movement of the carriage means and the pivotal movement of the hold-down rod on the carriage means enabling placement of the hold-down rod at any vertical position on the tray and the spring action on the slide means of the hold-down rod enabling the rod in its mid-position relative to the carriage means to be maintained centrally well above the face of the tray so as to be out of the way and not impede any desired movement, introduction or withdrawal by the user of a document relative to the face of the tray.

3. In a document display device, including a leg supported tray with a document display surface having side and end edges, and a document hold-down means movable by the user across the document display surface of the device, the improvement wherein said document hold-down means comprises guide rods extending front to rear of the document display surface substantially at the side edges thereof, carriage means on and movable by the user along said guide rods throughout the span thereof between the front and the rear of the document display surface, a hold-down rod with the ends thereof mounted for pivotal movement with respect to said carriage means and with a central portion laterally offset from said carriage means, said central portion spanning substantially the entire width of said document display surface, spring means acting between said carriage means and said hold-down rod to normally urge the rod toward the document display surface, the coordinated movability of the carriage means on the guide rods and the pivotal movability of the hold-down rod on the carriage means enabling placement by the user of the central portion of the hold-down rod in any position front to rear relative to the document display surface.

4. In a document display device according to claim 3, the improvement wherein said guide rods are arranged parallel to said document display surface and the pivotal movement of the hold-down rod with respect to the carriage means is about trunnion means on said carriage means and about axes parallel to said document display surface.

5. In a document display device according to claim 3, slide means situated near the ends of said hold-down rod against which said spring means acting between said carriage means and said hold-down rod are urged, said hold-down rod being urged toward said document display surface when the rod is moved to a position closely adjacent said document display surface and said hold-down rod being held in a mid-position by said spring means when centrally positioned on said carriage means.

* * * * *